US010662717B2

(12) United States Patent
Borra

(10) Patent No.: US 10,662,717 B2
(45) Date of Patent: May 26, 2020

(54) TELESCOPIC MAST FOR DRILLING AND ASSOCIATED DRILLING RIG

(71) Applicant: DRILLMEC SPA, Gariga di Podenzano (PC) (IT)

(72) Inventor: Bruno Borra, Gariga di Podenzano (IT)

(73) Assignee: DRILLMEC S.P.A., Gariga Di Podenzano (PC) (IT)

( * ) Notice: Subject to any disclaimer, the term of this patent is extended or adjusted under 35 U.S.C. 154(b) by 149 days.

(21) Appl. No.: 15/029,990

(22) PCT Filed: Oct. 9, 2014

(86) PCT No.: PCT/IB2014/065176
§ 371 (c)(1),
(2) Date: Apr. 15, 2016

(87) PCT Pub. No.: WO2015/056132
PCT Pub. Date: Apr. 23, 2015

(65) Prior Publication Data

US 2016/0251906 A1 Sep. 1, 2016

(30) Foreign Application Priority Data

Oct. 18, 2013 (IT) ..... TO2013A0850

(51) Int. Cl.
*E21B 15/00* (2006.01)
*E21B 7/02* (2006.01)

(52) U.S. Cl.
CPC ..... *E21B 15/00* (2013.01); *E21B 7/023* (2013.01)

(58) Field of Classification Search
CPC ..... E21B 7/023; E21B 15/00
See application file for complete search history.

(56) References Cited

U.S. PATENT DOCUMENTS 3,814,194 A * 6/1974 Reich ..... E21B 7/023 173/152
4,249,600 A 2/1981 Bailey
(Continued)

FOREIGN PATENT DOCUMENTS

EP 0548900 A2 6/1993
EP 1881151 A1 1/2008
(Continued)

OTHER PUBLICATIONS

International Search Report and Written Opinion for International Application No. PCT/IB2014/065176, dated Jan. 21, 2015.

*Primary Examiner* — Robert E Fuller
(74) *Attorney, Agent, or Firm* — Merchant & Gould P.C.

(57) ABSTRACT

A telescopic mast includes at least one first structure including a fixing portion adapted to be fixed to a drill floor. At least one second structure is mobile relative to the first structure, to obtain a telescopic mast. A moving system is adapted to extend and retract a longitudinal extension of the telescopic mast, by moving the second structure. The moving system includes at least one first actuator device, adapted to be fixed to the first structure or to the drill floor at its first end. The second structure is fixed at a first end of at least one second actuator device. At least one supply chamber is adapted to supply at least the first actuator device and at least the second actuator. At least one first actuator device and the at least one second actuator device are aligned along a single direction and operate with opposite directions.

11 Claims, 8 Drawing Sheets

(56) References Cited

U.S. PATENT DOCUMENTS

| | | | | |
|---|---|---|---|---|
| 2005/0191050 | A1 | 9/2005 | Chapman | |
| 2009/0314547 | A1* | 12/2009 | Stoetzer | E21B 7/023 175/57 |

FOREIGN PATENT DOCUMENTS

| | | | |
|---|---|---|---|
| GB | 2270100 | A | 3/1994 |
| WO | 2008/125110 | A2 | 10/2008 |

* cited by examiner

Fig. 3A
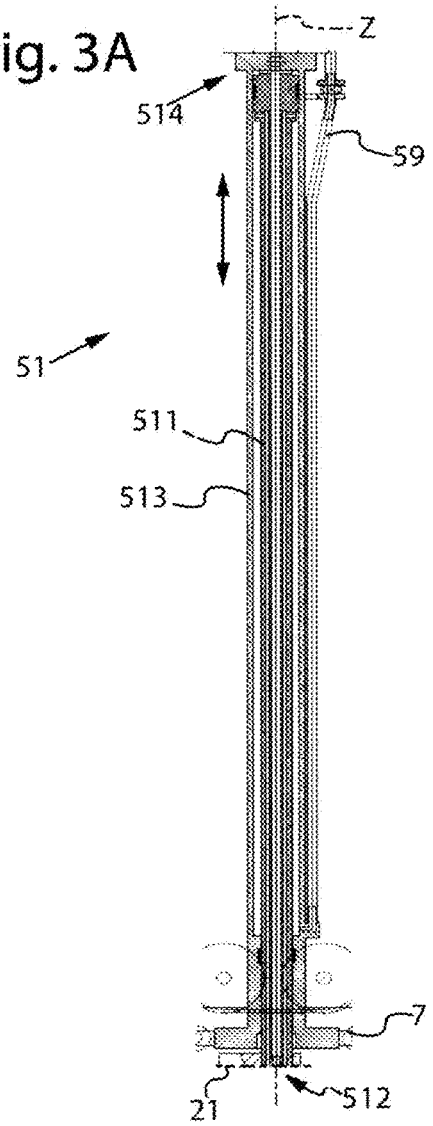
Fig. 3B
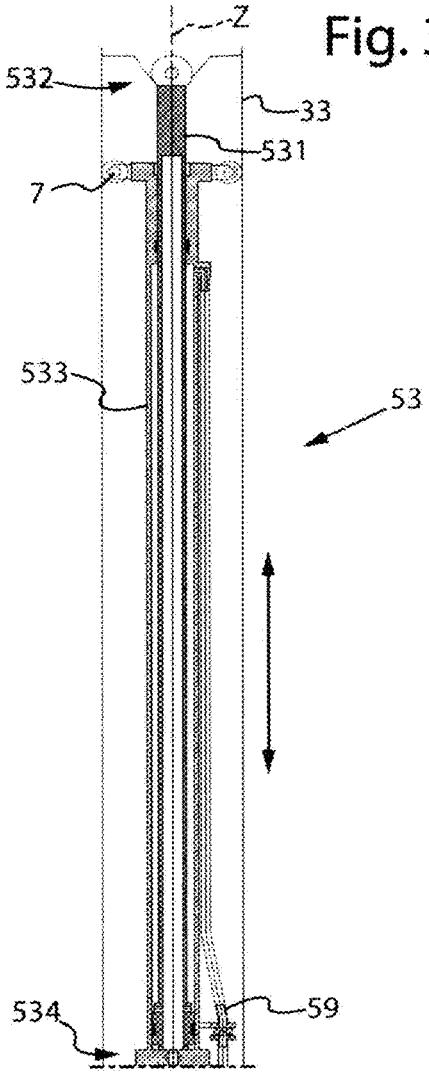
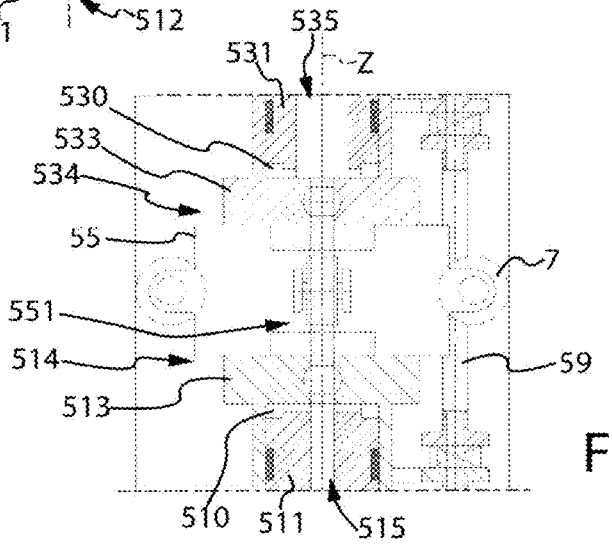
Fig. 3C

TELESCOPIC MAST FOR DRILLING AND ASSOCIATED DRILLING RIG

CROSS REFERENCE TO RELATED APPLICATIONS

This application is a National Stage Application of International Application No. PCT/IB2014/065176, filed 9 Oct. 2014, which claims benefit of Ser. No. TO2013A000850, filed 18 Oct. 2013 in Italy and which applications are incorporated herein by reference. To the extent appropriate, a claim of priority is made to each of the above disclosed applications.

BACKGROUND OF THE INVENTION

The present invention relates to a mast for telescopic drilling and to a drilling rig for oil wells provided with a telescopic mast, preferably an oil-pressure one with double pistons.

The drilling rig according to the present invention is a high-mobility and electro-hydraulic drilling rig comprising a telescopic mast and an automatic drill pipe stowing and handling system for greater efficiency and operating safety.

The mast according to the present invention is a double-piston and double-effect telescopic mast to extend or retract the mast, thus increasing or decreasing its longitudinal extension.

The great demand for energy and the increasing depletion of producing oil fields has progressively pushed the search for oil to deeper and deeper areas that get more and more challenging. This new situation leads operators to drill geological formations that are more complex and hostile.

At the same time, the need has arisen to improve health and environmental safety quality standards, also known to a skilled person as health, safety, environmental and quality (HSEQ), as well as the operating performances of drilling rigs.

From the point of view of HSEQ improvement, of a reduction of drilling times and, above all, of a reduction of non-productive times, also known to a skilled person with the acronym "NPT", the different operators working in this field have focused their technological innovation on drilling rigs with a high degree of automation, for the purpose of optimizing the entire well drilling process.

As a person skilled in the art knows, the drilling process can be divided into three macro-step: a first preparation step, during which, for example, the drilling rig is transported; a second step, during which the drilling rig is assembled or disassembled at the drilling site, also known as rig up and rig down; and a third actual drilling step, during which operators add or remove one or more drill pipes, which are connected to one another in series and define the drilling length, wherein drilling length means, as a skilled person knows, one or more drill pipes connected to one another in series.

The market mostly requires drilling rigs that can be easily moved, namely that can be moved to different drilling sites, and that feature high performances from the point of view of the actual drilling, namely that use series of drill pipes joined to one another and inserted into the well with great drilling lengths, for example starting from 27 m. Furthermore, drilling rigs are requested to have drill pipes or series of drill pipes that can be quickly inserted and removed, also fulfilling high HSEQ standards, so as to obtain a high degree of automation.

The technical features required for the drilling, in order to reduce the trip-in time and the trip-out time of a drilling system, lead the constructors of said drilling rigs to manufacture drilling rigs that allow users to use a drill string that is as long as possible. Conventional ground rigs for deep drilling use drilling lengths, also known to a skilled person as stands, starting from 27 m. Normally, this technical feature forces constructors to manufacture drilling rigs with large dimensions.

This manufacturing feature generates a technical problem concerning the transportation of a structure with remarkable dimensions, both in terms of weight and size and in terms of ability to actually maneuver the vehicle on which the mast and the other elements of the drilling rigs are arranged.

The European patent no. EP0548900 describes a mobile drilling rig comprising a telescopic mast, which can be extended by means of a central hydraulic cylinder.

Furthermore, small and medium sized drilling rigs are known, which comprise a telescopic mast and in which, during transportation, said mast is closed and arranged horizontally, for example, on a transportation vehicle.

Drilling rigs with a telescopic mast have a mast with a longitudinal extension that, in an extended operating configuration, is significantly smaller compared to fixed masts. Normally, the longitudinal extension of these masts is directly connected to the stroke that the moving system applied can perform.

The technological limit to the extension of the stroke that can be performed by the telescopic mast—and, therefore, to its maximum longitudinal extension—is strictly connected to the limitations and to the features of the oil-pressure actuator commonly used to move to the mast to during drilling operations.

Prior art hydraulic systems for ground drilling activities, in order to speed up rig up and rig down times, reduce the height of the mast, thus leading to drawbacks in terms of drilling speed and operating safety, since series of drill pipes with a reduced drilling length (13.5 or 18 m) can be used without stopping the drilling mud pumping system to add a further length.

A prejudice of the prior art establishes that, in order to use longer series of drill pipes, one needs to increase the dimensions and the weight of the mast, so as to obtain a mast with a greater longitudinal extension, thus jeopardizing, though, rig up and rig down times and the transportation of the drilling rigs.

Another problem arising from the increase in the dimensions and, in particular, in the weight of the drilling rig and, in particular, of the mast relates to the forces acting upon the mast. As a matter of fact, structures with large dimensions produce an increase in the compression force acting upon the mast, which is transferred, through the drill floor, to the base section.

A further technological restriction establishes that the structure of the mast, which is adapted to control the movements of the carriage comprising the drilling head, must be able to counter the torsion transmitted to the drill string by the drilling head itself. Furthermore, the great length of the mast can cause a bending moment, which is generated by the lack of symmetry of the compression forces relative to the longitudinal axis of the mast.

In order to solve these technical problems and avoid damages to the structure of the mast, constructors increase the dimensions of the mast even more, so as to strengthen the structure of the mast itself. The greater sturdiness of the mast, though, worsens the technical problem concerning the increase in the mass of the drilling rig.

The increase in the overall mass and dimensions of the drilling rig leads to an increase in the costs for the installation and the removal of the drilling rig itself.

The need to have drilling rigs able to reach greater drilling lengths without loosing safety and quick handling features requires a technological improvement concerning the increase in the length of the drill pipes or drill strings to be inserted into the well, for example from 13.5 m to 27 m, which can be handled by a telescopic mast.

The increase in the length of the drill pipes or drill strings leads to an increase in the length of the mast itself and, thus, to an increase in the stroke performed by the mast moving system.

Patent applications are known, for example patent application No. U.S. Pat. No. 4,249,600, in which telescopic masts are described, which comprise more than one actuator adapted to extend and reduce the longitudinal extension of the mast.

All prior art documents, in order to increase the length of the mast so as to be able to use drill strings with a length up to 27 meters, use very complex and bulky moving systems, which reduce the rig up and rig down speed of the drilling rig, thus also jeopardizing the transportation thereof.

Furthermore, patent application Ser. No. GB2270100 discloses a moving system for a travelling block, which comprises, in an embodiment, two opposite coaxial pistons. Said travelling block moving system can be implemented only in masts with a predetermined length and not in telescopic masts. This document does not provide any technical teach that is able to suggest the use of double pistons to extend or retract the longitudinal extension of the mast.

SUMMARY OF THE INVENTION

The object of the present invention is to solve the technical problems mentioned above by providing a telescopic mast for drilling rigs, which has relatively small dimensions and, hence, takes up a reduced amount of space, thus ensuring a high degree of mobility of the drilling rig and permitting, at the same time, the use of drill pipes or drill strings with greater lengths, for example 27 m, for the purpose of increasing drilling performances.

The mast according to the present invention can be applied to drilling rigs, thus remarkably reducing rig up and rig down times, significantly increasing drilling performances compared to drilling rigs with traditional telescopic masts, and ensuring a high mobility.

An aspect of the present invention relates to a telescopic mast which comprises a moving system with a double actuating device to move the mast and cause it to extend and retract its longitudinal extension.

A further aspect of the present invention relates to a drilling rig comprising a mast.

BRIEF DESCRIPTION OF THE DRAWINGS

The features and advantages of the telescopic mast according to the present invention and of the drilling rig associated therewith will be best understood upon perusal of the following description of non-limiting explanatory embodiments and of the accompanying drawings, which respectively show what follows:

FIG. 1A shows the mast in a retracted operating configuration, FIG. 1B shows the mast in an extended operating configuration;

FIG. 2A shows the mast in a retracted operating configuration, FIG. 2B shows the mast in an extended operating configuration;

FIGS. 3A, 3B and 3C show details of the moving system applied to the mast according to FIGS. 2A and 2B, in particular: FIG. 3A shows a first actuator device arranged in the lower portion of the mast, FIG. 3B shows a second actuator device arranged in the upper portion of the mast, FIG. 3C shows a supply chamber for the actuator devices, which is arranged between said first actuator device and said second actuator device;

DETAILED DESCRIPTION OF THE PREFERRED EMBODIMENT(S)

Figure 1B:
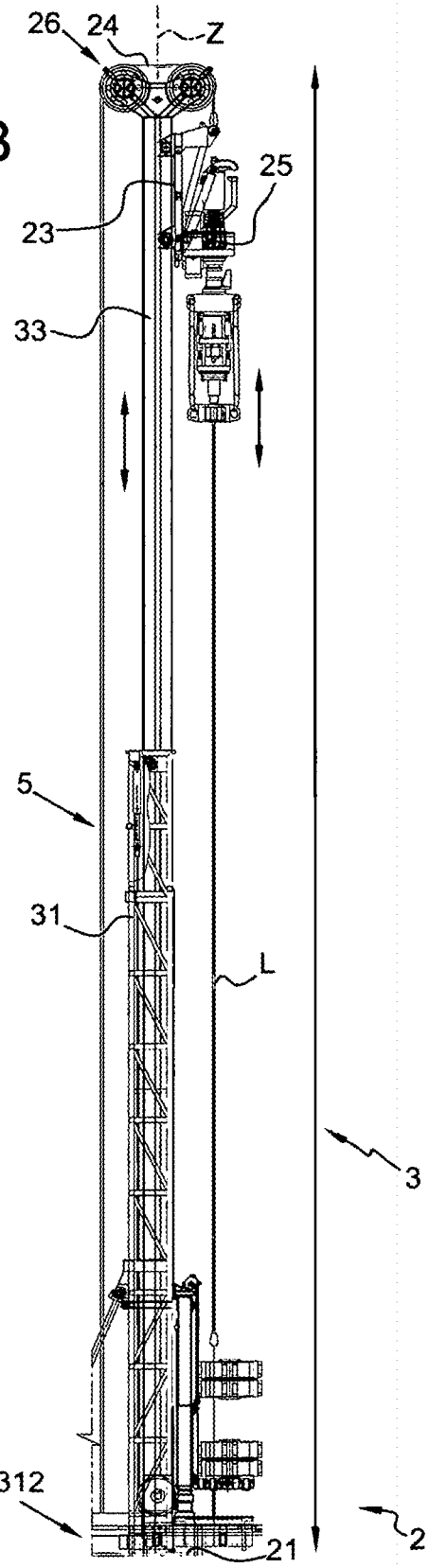
FIGS. 1A and 1B show a first explanatory embodiment of the telescopic mast, in particular.

With reference to the figures mentioned above, telescopic mast 3 is of the telescopic type.

Mast 3 comprises: at least one first structure 31, each comprising, in turn, a fixing portion 312, adapted to be fixed to a drill floor 21; at least one second structure 33, mobile relative to said at least one first structure 31, so as to obtain a telescopic mast 3; and a moving system 5, adapted to at least extend and retract a longitudinal extension "L" of said telescopic mast 3, in particular by moving said at least one second structure 33. Preferably, said moving system 5 is able to move said at least one second structure 33 along a vertical direction "Z", especially when mast 3 is arranged on said drill floor 21 in a vertical position.

Said mast 3 is able to at least assume an extended operating configuration, in which mast 3 is completely extended and has its maximum longitudinal length "L", and a retracted operating configuration, in which mast 3 is completely retracted and has its minimum longitudinal extension "L".

The mast according to the present invention can be applied to a drilling rig 2 comprising: a drill floor 21, on which said at least one first structure 31 is fixed; a drilling head 25, which, in use, is adapted to slide along at least part of the longitudinal extension of said mast 3. Said drilling head 25 is preferably mounted on travelling block 23, adapted to slide along guides provided on said mast 3.

A hoisting wire rope handling system, here represented by an indicating an non-limiting embodiment with a plurality of pulleys 26, is assembled on said at least one second mobile structure 33 of mast 3, for example at an end thereof.

Said plurality of pulleys 26 allow hoisting wire ropes 24 to slide so as to move said travelling block 23 as well as the drilling head 25 connected thereto.

Said fixing portion 312 is arranged at an end, in particular the lower one, of the first structure 31 of telescopic mast 3. The same fixing portion 312 represents at least one portion of the base of mast 3.

In general, said at least one first structure 31 is fixed, namely fixed in a rigid manner to said drill floor 21 by means of said fixing portion 312, whereas said second structure 33 is adapted to slide relative to said at least one first structure 31 by means of guides.

Said at least one first structure 31 and said at least one second structure 33 of mast 3 can be manufactured, in the explanatory and non-limiting embodiment shown in the figures, with trestle structures or with box-shaped profiles. Any other constructing and manufacturing solution is to be considered as covered by the present description.

Figure 1A:
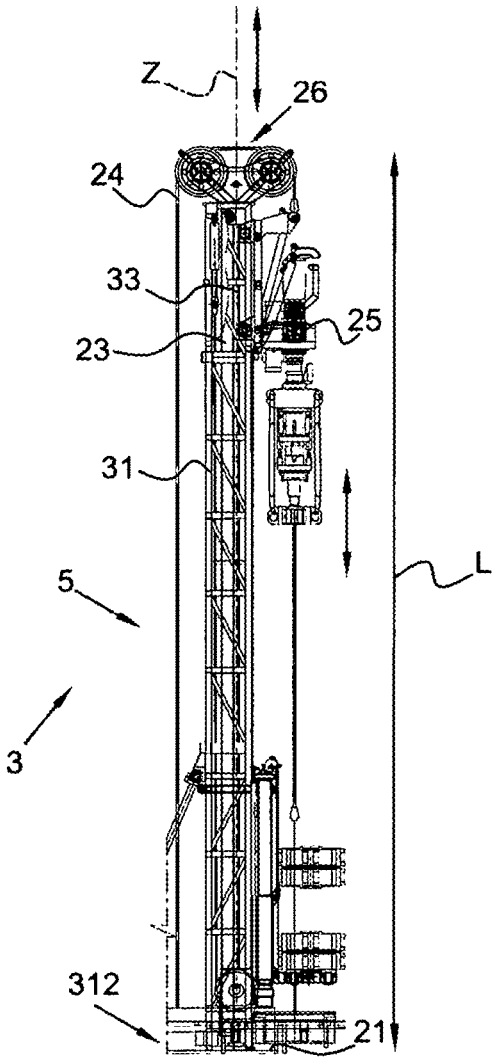

FIGS. 1A and 1B show a first embodiment of telescopic mast 3 according to the present invention.

Figure 2A:
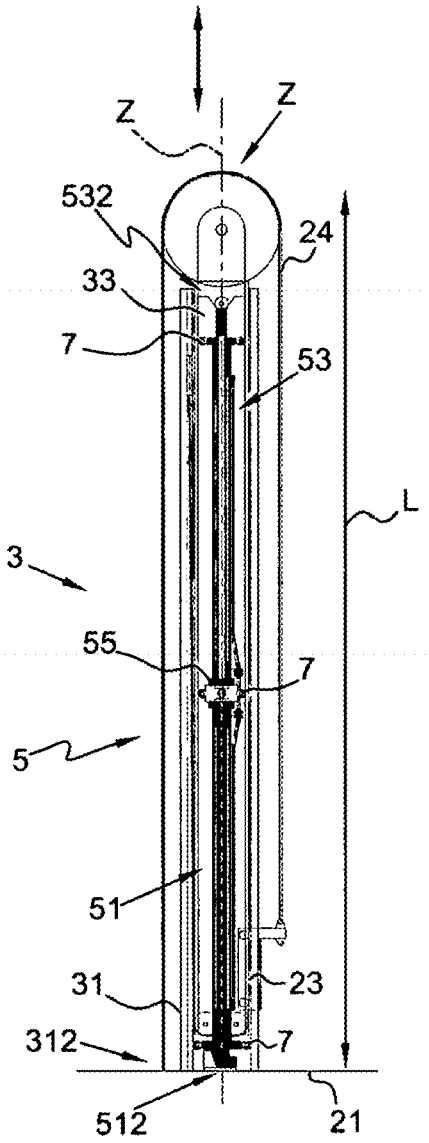
FIGS. 2A and 2B show, in a section view, a second explanatory embodiment of the telescopic mast, in particular.
Figure 2B:
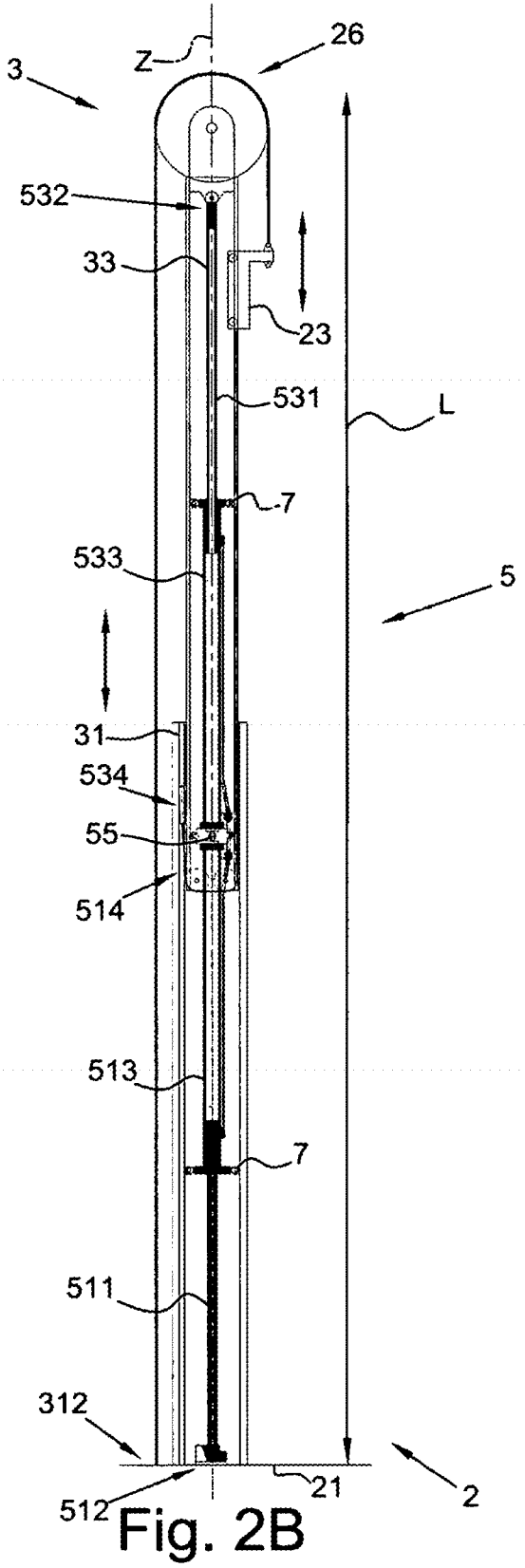

FIGS. 2A and 2B show a second embodiment of telescopic mast 3 according to the present invention.

In general, mast 3 according to the present invention can comprise a pull-down mechanism, which is known to a person skilled in the art, in different building configurations and as a function of the technical features of the project.

Preferably, mast 3 comprises one single first structure 31 and one single second structure 33.

Embodiments comprising more first and/or second structures, which are not shown, for example a first structure and at least two second structures arranged in a telescopic manner relative to one another, should be considered as part of the scope of protection of the present invention.

Said first structure 31 is fixed and fitted to drill floor 21 by means of said fixing portion 312; whereas said second structure 33 is adapted to slide inside the first structure 31 by means of guides, which are not shown in detail.

In general, said moving system 5 is arranged inside mast 3, in particular inside said first structure 31 and said second structure 33.

Moving system 5 comprises a plurality of guide elements 7, for example rotary elements, which are adapted to guide the movement of the moving system during its extensions or retractions known to a person skilled in the art.

Said moving system 5 can also be used to move said drilling head 25 by moving said plurality of pulleys 26. Said pulleys 26, during their movement along the vertical direction "Z", are able to release or recover said hoisting wire ropes 24, thus moving said drilling head 25.

In general, said moving system 5 comprises at least one first actuator device 51 and at least one second actuator device 53, and at least one supply chamber 55.

Said at least one first actuator device 51, at its first end 512, is fixed to said first structure 31 or to said drill floor 21.

Said at least one second actuator device 53, at its first end 532, is fixed to said second structure 33.

Said at least one supply chamber 55 is adapted to supply at least said first actuator device 51 and at least said second actuator 53.

For example, said at least one supply chamber 55 is adapted to supply, during the extension of said telescopic mast 3, thanks to a fluid coming from said at least one first actuator device 51, said at least one second actuator device 53.

Said at least one first actuator device 51 and said at least one second actuator device 53 are aligned along a single direction, for example along the vertical direction "Z".

Said at least one first actuator device 51 and said at least one second actuator device 53 act in directions that are opposite to one another.

Preferably, said at least one first actuator device 51 and said at least one second actuator device 53 are aligned with one another and are opposed to one another, since they act along directions that are opposite to one another. If necessary, said at least one first actuator device 51 and said at least one second actuator device 53 are independent of one another.

For the purposes of the present invention, the term "aligned actuator devices" means that these actuator devices lie along a common direction, preferably along the same straight line, along which they act.

Figure 4:
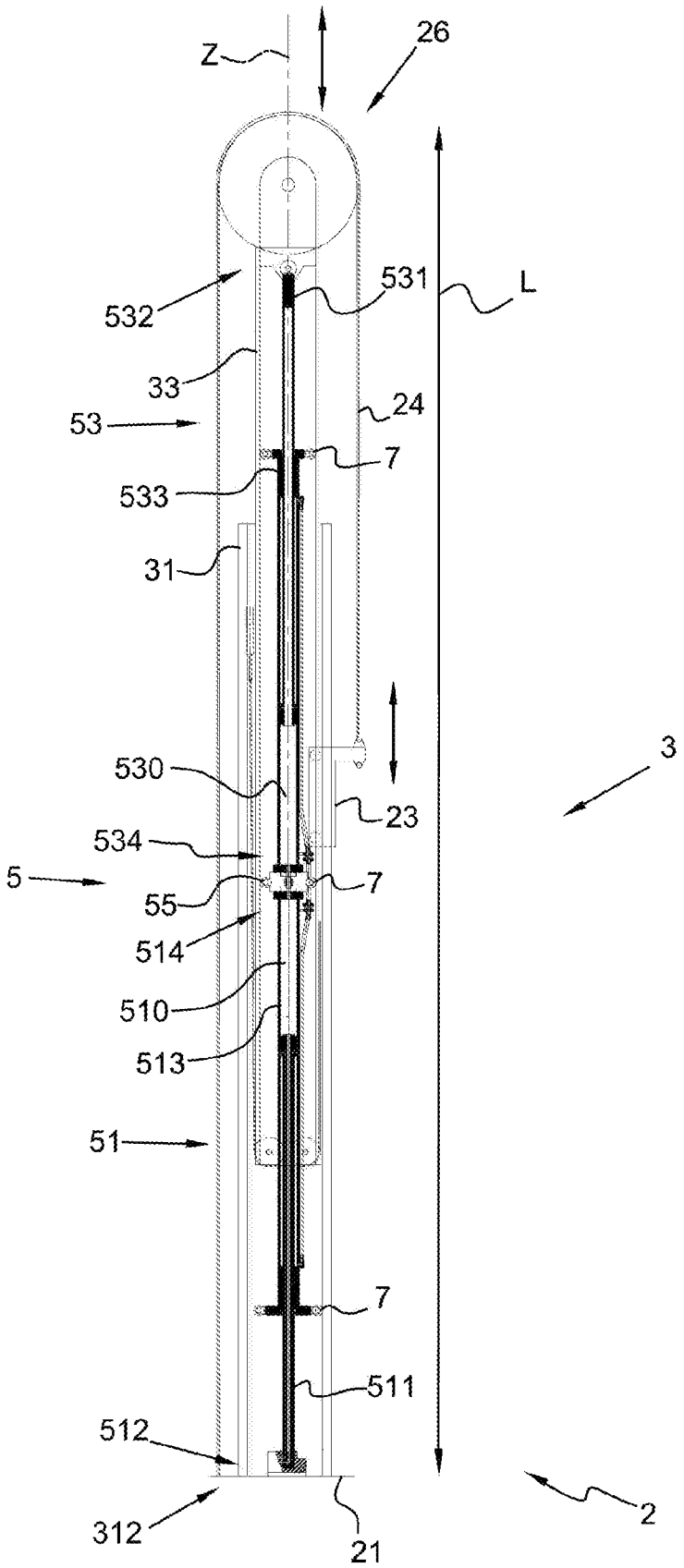
FIG. 4 shows, in a section view, the mast of FIGS. 2A and 2B in an intermediate operating configuration.

For the purposes of the present invention, the term "opposed actuator devices" means that the actions of at least two actuator devices have directions that are substantially opposite to one another, since they act in opposition to one another, but preferably not in contrast with one another, as shown for example in FIGS. 2A, 2B, 4.

Preferably, each actuator device 51, 53 comprised in moving system 5 comprises its own guide elements 7, which are such as to allow it to move correctly. Preferably, supply chamber 55 itself comprises its own guide elements 7, as you can see, by way of example, in FIGS. 3A-3C, 6A-6C and 7A-7C.

FIGS. 1A and 2A show two embodiments of telescopic mast 3 in a retracted operating configuration. When mast 3 is in the retracted operating configuration, drilling rig 2 is performing, for example, the drilling step, during which the drill pipes, which are assembled so as to obtain the drilling length, are wedged in at the level of a rotary table, not shown in detail, which is comprised in drill floor 21 of drilling rig 2.

FIGS. 1B and 2B show two embodiments of telescopic mast 3 in an extended operating configuration. When mast 3 is in the extended operating configuration, drilling rig 2 is able, for example, to perform the initial drilling steps or operations, during which, as a skilled person knows, a plurality of drill pipes with the desired drilling length are arranged so as to face one another and screwed to the drilling column already inserted into the wellbore. In the extended operating configuration of mast 3, the plurality of drill pipes are completely out of the drill hole. Mast 3 assumes the extended operating configuration of FIG. 1B or 2B, for example, also at the end of the tripping operation to pull the drill series with the desired drilling length out of the wellbore during trip-out procedures, as a person skilled in the art knows.

In general, said moving system 5 comprises at least one first actuator device 51 and at least one second actuator device 53, and at least one supply chamber 55. Preferably, a supply chamber 55 is fixed to a second end 514 of a first actuator device 51 and to a second end 534 of a second actuator device 53, thus being arranged between two actuator devices 51, 53 and moving with them in an integral manner.

In general, each supply chamber 55 causes two actuator devices 51, 53 to communicate with one another. This configuration allows at least one of said actuator devices to be uncoupled during the disassembly operations of mast 3 and of drilling rig 2 and during their subsequent transportation to another drilling site.

Figure 6C:
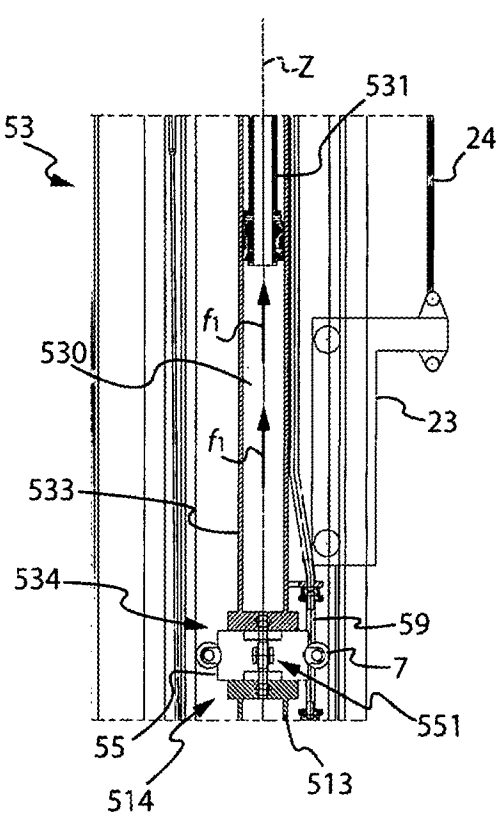
FIGS. 6A, 6B and 6C show, by way of example, in a section view, details of the moving system of the FIG. 3A-3C, which clearly show the path of the fluid flow inside the moving system to extend telescopic mast 3.
Figure 6B:
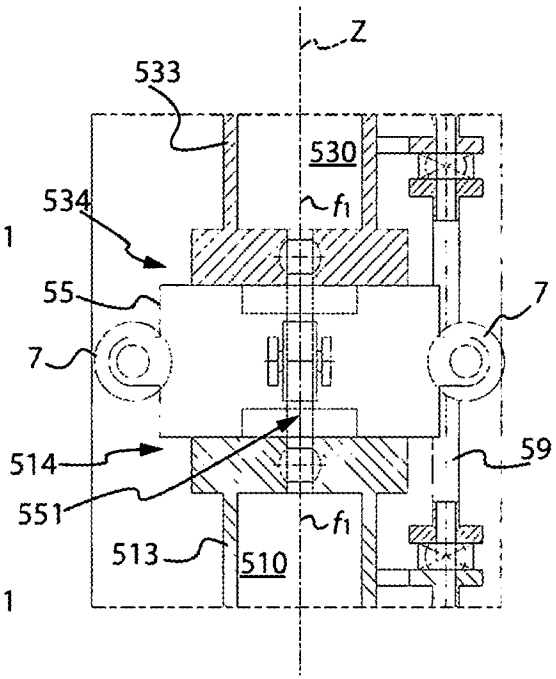
Figure 7C:
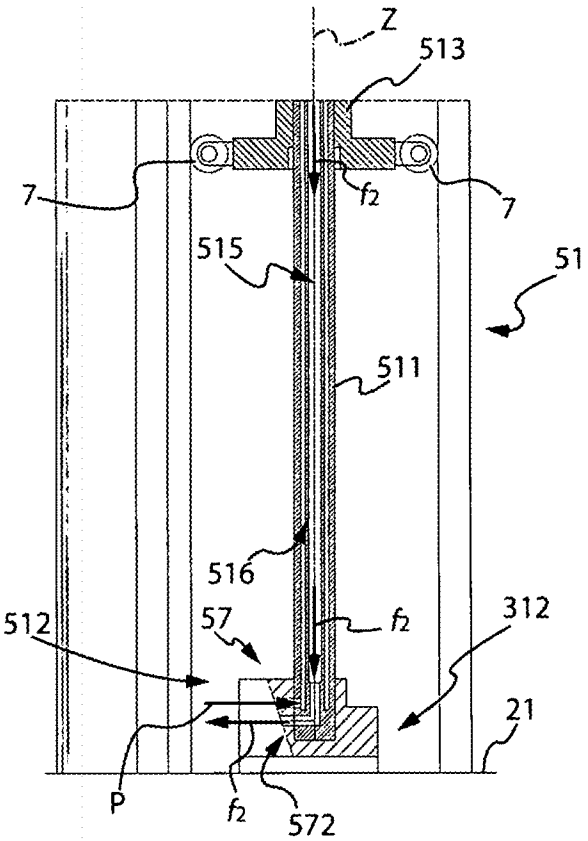
FIGS. 7A, 7B and 7C show, by way of example, in a section view, details of the moving system of the FIG. 3A-3C, which clearly show the path of the fluid flow inside the moving system to retract telescopic mast 3.
Figure 7B:
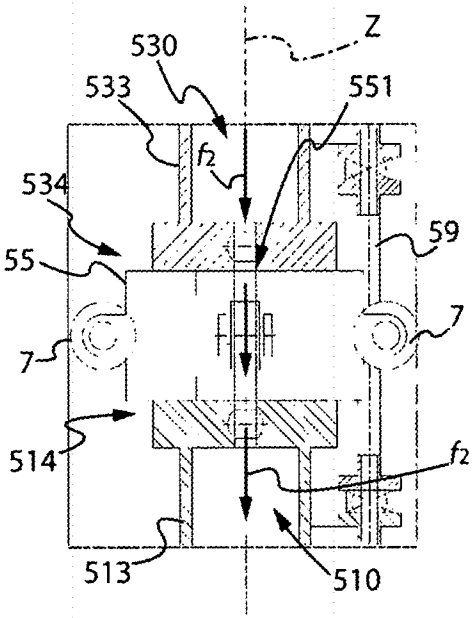

Said supply chamber 55 supplies at least one first chamber 510 of at least one first actuator device 51 and at least one second chamber 530 of at least one second actuator device 53, as shown, by way of example, in FIGS. 6B and 7B.

Supply chamber 55 and actuator devices 51, 53 connected thereto are shaped, for example, in such a way that the stroke performed by said actuator devices, after their activation, is substantially the same for all the actuator devices, as shown for example in FIG. 4.

In the embodiments shown in the figures by way of example, moving system 5 comprises one single first actuator device 51 and one single second actuator device 53, as well as one single supply chamber 55. Said supply chamber 55 is fixed to the second end 514 of the first actuator device 51 and to the second end 534 of the second actuator device 53, thus being arranged between the two actuator devices 51, 53 and moving with them in an integral manner.

As shown, for example, in FIG. 4, said supply chamber 55 moves together with the second end 514 of a first actuator device 51 in an integral manner.

Embodiments, not shown, comprising more first and/or second actuator devices, for example opposed to one another two by two along a single direction, should be considered as part of the scope of protection of the present invention.

Preferably, said at least one first actuator device 51 and/or said at least one second actuator device 53 are pistons or oil-pressure cylinders and said at least one supply chamber 55 is oil-pressure, as shown by way of example in FIGS. 3A-3C.

In alternative embodiments, which are not shown, the moving system is a hybrid system in which at least one actuator device can be a piston or an oil-pressure cylinder of the telescopic type.

Each one of said actuator devices 51, 53 comprises a rod 511, 531 and a relative body 513, 533; said rods 511, 531 slide inside the respective bodies 513, 533 along a vertical direction "Z" that is the same for all the actuator devices. Preferably, the direction in which the rods slide is opposite between said at least one first actuator device 51 and said at least one second actuator device 53.

As shown by way of example in FIG. 3A, said first actuator device 51 comprises a first body 513 and a first rod 511, which is adapted to slide inside said first body 513. As shown in FIGS. 2A, 2B, 3A and 4, the movement of the first rod 511 relative to the first body 513 of the first actuator device 51 takes place long the vertical direction "Z".

Said first rod 511, in correspondence to the first end 512 of the first actuator device 51, is fixed to said drill floor 21 of drilling rig 2, for example in correspondence to fixing portion 312 of the first structure 31 of mast 3.

The first body 513 of the first actuator device 51, by moving vertically along said vertical direction "Z", causes the movement of supply chamber 55, which is fixed to the first body 513 of the first actuator device 51, in particular supply chamber 55 is fixed to the second end 514 of the first actuator device 51.

As shown by way of example in FIG. 3B, said second actuator device 53 comprises a second body 533 and a second rod 531, which is adapted to slide inside said second body 533. As shown in FIGS. 2A, 2B, 3B and 4, the movement of the second rod 531 relative to the second body 533 takes place along the vertical direction "Z".

Said second rod 531, in correspondence to the first end 532 of the second actuator device 53, is fixed to said second structure 33 of mast 3. In particular, said second end 532 is fixed to the upper end of the second structure 33 of mast 3.

Said second rod 531 can be at least partially hollow on the inside, as a function of the technical features of the project on the rigidity, mass and speed with which the second rod 531 slides out of the second body 533, as shown in FIGS. 3B, 3C and 6C, or closed.

Said pulleys 26 are assembled in correspondence to the upper end of the second structure 33 of mast 3.

Said pulleys 26 can be assembled so as to be fixed directly to said first end 532 of the second actuator device 53 or to said second structure 33, which, in turn, is fixed to the second actuator device 53. In particular, said plurality of pulleys 26 is preferably fixed to the second rod 531 of the second actuator device 53.

In correspondence to the upper end of the second structure 33 of telescopic mast 3 there is also connected a moving mechanism for hoisting wire ropes 24, which is not shown in detail. Said moving mechanism is able to move said plurality of pulleys 26. In an explanatory and non-limiting embodiment, the moving mechanism for the travelling bock is made up of at least one pulley, on which a hoisting rope is wound, as shown in FIG. 2. In other embodiments and, anyway, depending on the technical features of the project, the moving mechanism for the travelling bock can be made up of two pulleys 26, as shown in FIG. 1.

The second body 533 of the second actuator device 53, in correspondence to the second end 534 of the second actuator device 53, is constrained to said supply chamber 55.

In the explanatory but non-limiting embodiment shown in FIGS. 2A-4, said at least one first actuator device 51 and said at least one second actuator device 53 have the same bore and the same length. In general, depending on the technical features of the project, said actuator devices 51, 53 can have bores and lengths that are different from one another.

In an embodiment of said actuator devices, the actuator devices themselves are oil-pressure devices; in a non-limiting embodiment, said supply chamber 55 supplies the chambers of all said actuator devices 51, 53.

In the embodiment shown in FIG. 3C, said supply chamber 55 is arranged between two actuator devices 51, 53, thus causing said actuator devices to communicate with one another, in particular the first chamber 510 of the first actuator device 51 and the second chamber 530 of the second actuator device 53. Furthermore, said supply chamber 55 can move vertically along the vertical direction "Z" so as to be integral to the first actuator device 51 and, in particular, to the first body 513 of the first actuator device 51.

In the embodiment of FIG. 3C, the supply chamber causes the two actuator devices 51, 53 to communicate with one another, thus allowing them to be uncoupled when the drilling rig is moved and transported.

In the retracted operating configuration of mast 3, in which mast 3 is completely retracted, as shown by way of example in FIGS. 1A, 2A, 3A and 3B, the two actuator devices 51, 53 are completely retracted and the rods 511, 531 are completely inserted into the respective bodies 513, 533.

In the extended operating configuration of mast 3, in which mast 3 is completely extended, as shown by way of example in FIGS. 1B and 2B, the two actuator devices 51, 53 are completely extended and both rods 511, 531 have slid out of the respective bodies 513, 533 for the maximum possible length. In this configuration, the actuator devices 51, 53 reach the maximum possible length, thus allowing mast 3, as already mentioned before, to reach the maximum possible longitudinal extension "L", namely the maximum possible height of the drill floor.

In the extended operating configuration of mast 3, supply chamber 55 common to the two actuator devices 51, 53 reaches the maximum possible height relative to drill floor 21. This height is equal to the length of the first body 513 plus the stroke of the first rod 511 of the first actuator device 51.

In the extended operating configuration of mast 3, the plurality of pulleys 26 perform the entire stroke allowed and, as a consequence, travelling block 23 is moved.

FIG. 4 shows an intermediate operating configuration between the aforesaid extended and retracted operating configurations. The passage between the two operating configuration takes place by means of the progressive extraction or insertion of the second rod 531 relative to the second body 533 of the second actuator device 53 and by means of the similar extraction or insertion of the first rod 511 relative to the first body 513 of the first actuator device 51.

In general, moving system 5 of mast 3 according to the present invention, comprises at least one pressurization chamber 57 to supply moving system 5, which is preferably arranged in correspondence to fixing portion 312 of said at least one first structure 31. More preferably, said pressurization chamber 57 is arranged in correspondence to the first end 512 of the first actuator device 51.

The extension or retraction of mast 3 according to the present invention is due to the flowing, from and to said pressurization chamber 57, of at least one pressurized fluid flow f1, f2, P, for example oil.

Said pressurization chamber 57 comprises at least one first duct 572, adapted to be supplied for the extension of mast 3 and through which a first fluid flow "f1" flows. Pressurization chamber 57 also comprises a second duct 573, adapted to be supplied, by means of a third fluid flow "P", for the retraction of mast 3, so as to allow a second fluid flow "f2" to flow, in particular through said first duct 572 with a direction that is opposite to said first fluid flow "f1". FIGS. 6A-6C and 7A-7C show, by way of example, the two fluid flows "f1", "f2" inside moving system 5 and supply chamber 55 for the extension and the retraction of telescopic mast 3.

Said at least one first duct 572 is connected, according to the principles of fluid dynamics: to a first channel 515 comprised in said first actuator device 51; to said supply chamber 55; and to a second chamber 530 of the second actuator device 53, thus creating a first path for a first fluid flow "f1". If necessary, said first path for a fluid flow comprises a further section, which is created by means of a third channel 535, which is obtained in the second rod 531 of the second actuator device 53. Said third channel 535 is, for example, a chamber, which is shaped so as to make said second rod 531 of the second actuator device 53 at least partially hollow, as shown, by way of example, in FIG. 3C. Said third channel 535 can be left out in accordance with the technical features and the building requirements of telescopic mast 3 and, therefore, said rod 531 can be closed on the lower side.

Figure 6A:
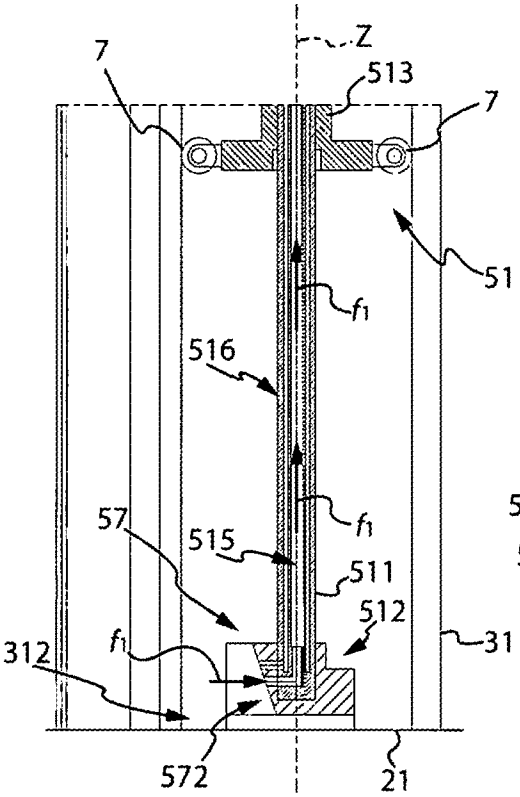

Said first channel 515 of the first actuator device 51, said supply chamber 55 and said second chamber 530 of the second actuator device 53 are connected, according to the principles of fluid dynamics, in a train-like manner relative to the direction of the first fluid flow "f1", as shown by way of example in FIGS. 6A-6C.

Said at least one second duct 573 is connected, according to the principles of fluid dynamics: to a second channel 516 comprised in the first actuator device 51, to a first compartment 517 of the first rod 513, to a pressurization circuit 59, and to a second compartment 537 of the second rod 531 of the second actuator device 53, so as to allow a second fluid flow "f2" to flow, in particular through said first duct 572 with a direction that is opposite to said first fluid flow "f1".

Said first channel 515 and said second channel 516 are obtained in at least one portion of the first rod 511 of the first actuator device 51. Said first channel 515 and said second channel 516 are connected to pressurization chamber 57 close to the first end 512.

Said first compartment 517 of the first actuator device 51 is obtained between the first body 513 and the first rod 511 of the first actuator device 51.

Said second compartment 537 of the second actuator device 53 is obtained between the second body 533 and the second rod 531 of the second actuator device 53.

Below we will briefly describe the path of the first fluid flow "f1" such as to permit the extension of mast 3.

Figure 5:
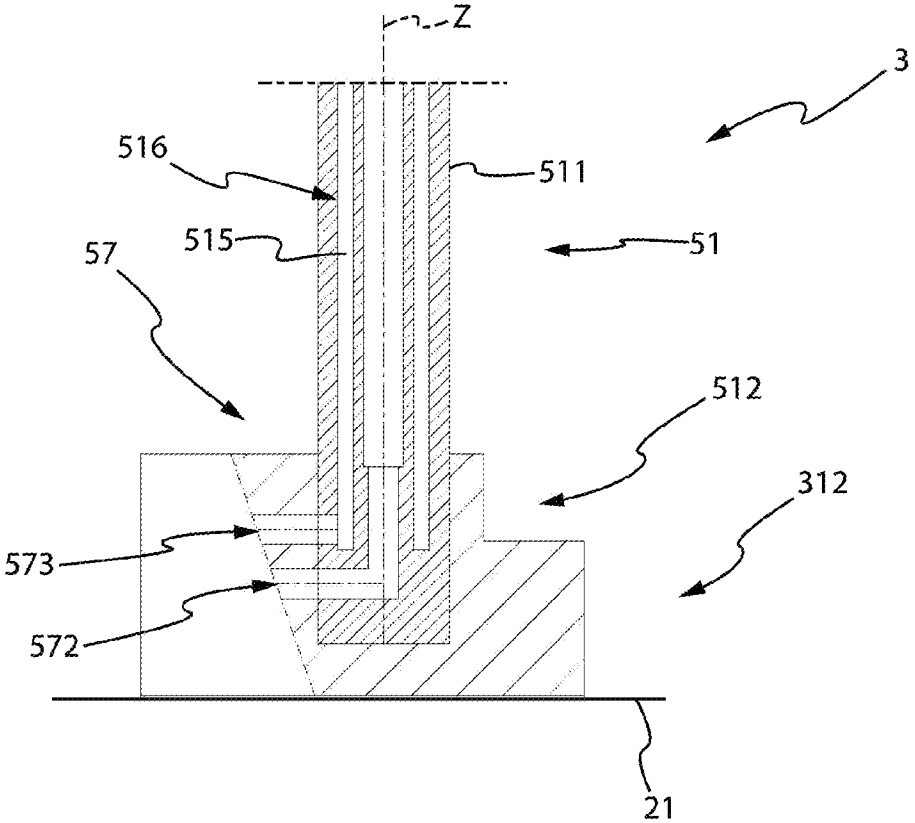
FIG. 5 shows, in a section view, an explanatory embodiment of the pressurization chamber of the moving system.

As shown by way of example in FIGS. 6A-6C, the first pressurized fluid flow "f1" enters the first duct 572 of pressurization chamber 57, as shown by way of example in FIG. 5. The first pressurized fluid flow "f1" follows the path indicated in FIG. 6A by the arrow inside the first channel 515 of the first rod 511 of the first actuator device 51. Said first rod 511 is preferably constrained to said pressurization chamber 57, which, in turn, is constrained to drill floor 21. As shown, for example, in FIG. 6B, the first pressurized fluid flow "f1" runs through the entire length of the first rod 511 until it flows out into the first chamber 510 of the first body 513 of the first actuator device 51. The first pressurized fluid flow "f1", due to the geometry of supply chamber 55, flows from the first chamber 510 of the first body 513 of the first actuator device 51 towards the second actuator device 53. Said supply chamber 55 is provided with a first passage 551, shown for example in FIG. 3C and 6B, which establishes a communication between the first chamber 510 of the first body 513 of the first actuator device 51 and the second chamber 530 of the second body 533 of the second actuator device 53. Said first passage 551 allows the pressure inside the two chambers 510, 530 of the two bodies 513, 533 of the two actuator devices 51, 53 to be the same. As shown by way of example in FIG. 6C, the first pressurized fluid flow "f1", which flows from the orifice of the first passage 551 towards the second chamber 530 of the second body 533 of the second actuator device 53, allows the second rod 531 to slide outwards relative to said second body 533 of the second actuator device 53. This movement of the first pressurized fluid flow "f1" from an actuator device to the other is shown in FIGS. 6A-6C.

In the preferred but non-limiting embodiment, since the pressure of the fluid astride of the supply chamber 55 is the same and since the pushing area of the two actuator devices 51, 53 is identical, the stroke performed by the rods 511, 531 inside the respective bodies 513, 533 is identical.

Figure 7A:
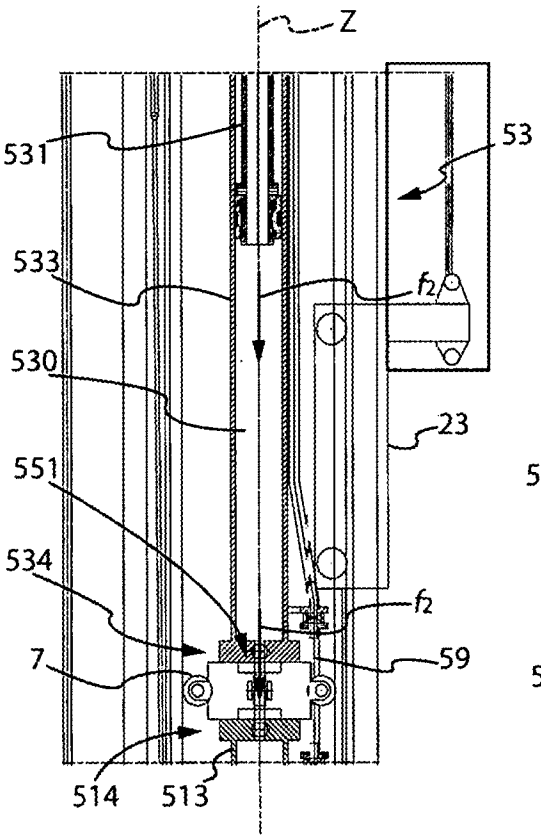

During the shortening step to retract telescopic mast 3, the second duct 573 of the pressurization chamber 57 is supplied by a third pressurized fluid flow "P", as shown for example in FIG. 7C, which is such as to force the generation of the second fluid flow "f2", as shown in FIGS. 7A-7C, whose direction and course are indicated by the arrows.

As shown by way of example in FIGS. 7A-7C, the second pressurized fluid flow "f2" flows out of the two chambers 510, 530 of the two bodies 513, 533 of the two actuator devices 51, 53, in particular flowing through said first channel 515, so as to connect to said first duct 572, thus following the path with an opposite direction relative to the flowing direction of the first fluid flow "f1" in case of extension of mast 3.

The steps aimed at retracting telescopic mast 3 require a very careful control of the operations, as a person skilled in the art knows. These operating steps are controlled thanks to the pressurization of the second duct 573 of pressurization chamber 57, which is shown for example in FIGS. 5 and 7C. As shown by way of example in FIGS. 7C, 8A and 8B, by injecting the third fluid flow "P" into said second duct 573, one can generate the second fluid flow "f2" described above. As show for example in FIG. 7C, said second duct 573 is in communication with the second channel 516 of the first actuator device 51. Said second channel 516 preferably is an annular chamber comprised in the first rod 511 of the first actuator device 51.

Figure 8A:
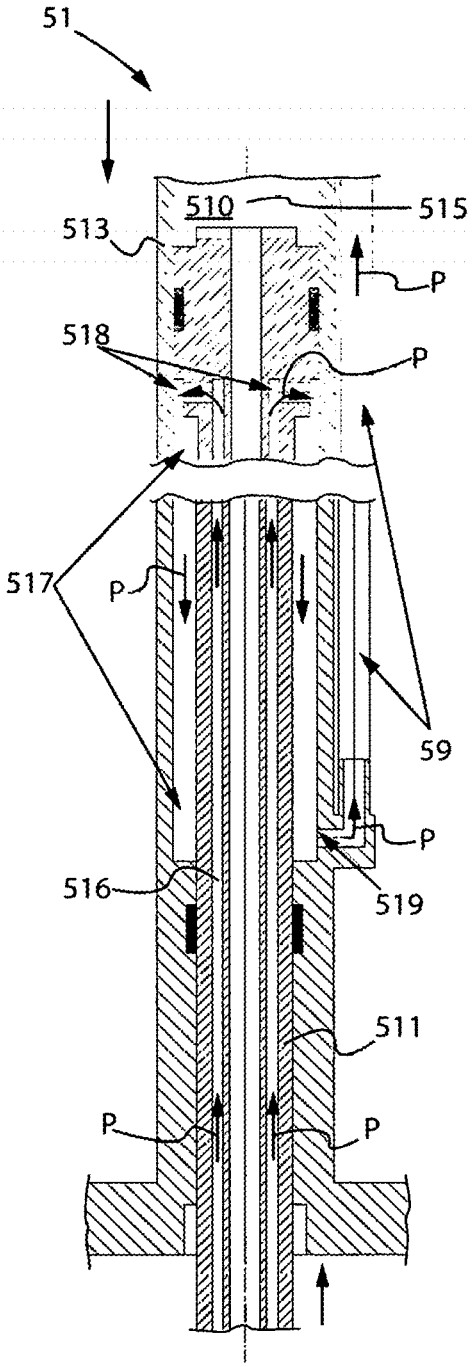
FIGS. 8A and 8B show, by way of example, in a section view, details of the first and the second actuator device of the moving system in particular portions for the circulation of the fluid flows to retract the telescopic mast.
Figure 8B:
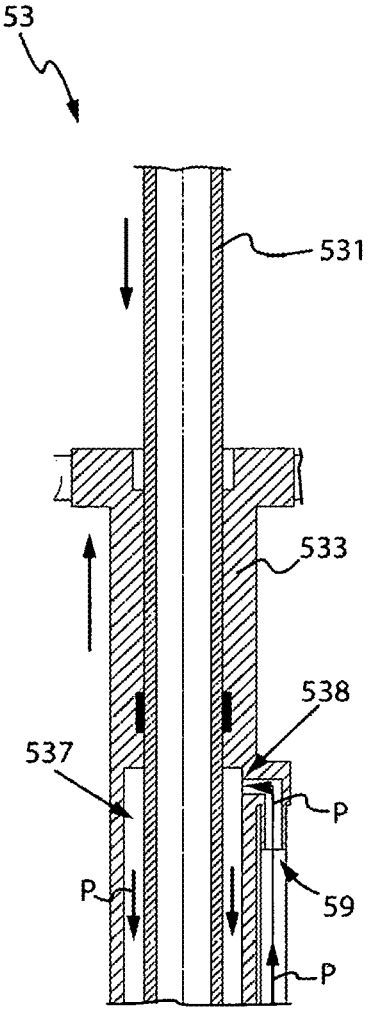

As shown by way of example in FIG. 8A, said second channel 516 allows a first compartment 517 comprised in the first rod 511 of the first actuator device 51 to be pressurized. Said second channel 516 is in communication with said first compartment 517 by means of a first orifice 518, as shown by way of example in FIG. 8A. Said first compartment 517 of the first rod 511 of the first actuator device 51 is in communication, by means of a second orifice 519, with said pressurization circuit 59, as shown by way of example in FIG. 8A. Said pressurization circuit 59 is preferably arranged on the outside relative to at least one of said actuator devices 51, 53, more preferably it is arranged on the outside of both of them. Said outer pressurization circuit 59, in an explanatory and non-limiting embodiment, has a substantially stiff structure, which, though, can be properly shaped. Said pressurization chamber 59 is connected, according to the principles of fluid dynamics, to a second compartment 537 of the second rod 531 of the second actuator device 53 through a third orifice 538, as shown by way of example in FIG. 8B.

The proper pressurization of the second duct 573 of pressurization chamber 57, for example through the third fluid flow "P", allows the outflow of the fluid "f2" from the chambers 510, 530 of the bodies 513, 533 of the actuator devices 51, 53 to be controlled during the retraction of telescopic mast 3.

The double-piston and double-effect mechanism made up of the first actuator device 51 and the second actuator device 53 and suited to move a telescopic mast 3 for oil drilling rigs, which is described and explained by way of non-limiting example in the present description, can perform drilling operations with drill strings consisting of two drill pipes of the type "range 3", which are known to a person skilled in the art. The drilling length deriving from the string of drill pipes also comprises tool joints, as a person skilled in the art knows.

The double-actuator and double-effect moving mechanism, for example with two pistons, suited to move a telescopic mast 3 for oil drilling rigs, which is described and explained by way of non-limiting example, can reach a moving speed of travelling block 23, in particular along a vertical direction, of 1 m/s, so as to move drilling head 25.

The double-actuator and double-effect moving mechanism, for example with two oil-pressure pistons, suited to move a telescopic mast 3 for oil drilling rigs, which is described and explained by way of non-limiting example, can reach pulling forces up to 600 metric tones.

Drilling rig 2 according to the present invention comprises a mast 3, which comprises, in turn, a pantograph mechanism to move said drilling head 25, so as to move one or more drill pipes from a mouse hole to a center well and vice versa, as shown by way of example in FIGS. 1A and 1B.

Drilling rig 2 according to the present invention can comprise, according to its technical features, a pull-down mechanism, as a person skilled in the art knows.

The drilling rig according to the present invention comprises an oil-pressure telescopic mast 3 with two pistons to drill oil wells having the features described above.

The present invention uses, as a starting point, drilling rigs that can be quickly assembled (rig up) and disassembled (rig down), also known as fast moving rigs, preferably of the hydraulic type, for example adapted to create small- and medium-depth wells and characterized by the fact that they can be quickly moved form one site to the other. The present invention preserves these features, though increasing the drilling length from 13.5 m to 27 m.

This allows the drilling rigs according to the present invention to drill medium- and large-depth wells and to create extended reach wells, thus reducing the number of interruptions for the addition or removal of drill strings, or drilling length, with clear operating, economic and safety advantages resulting therefrom.

The present invention does not change the relatively small dimensions and spaces of known drilling rigs comprising telescopic masts and, at the same time, increases the drilling length, thus increasing the longitudinal extension "L" of mast 3.

Possible embodiments of the drilling rig and of the mast that are not shown in the drawings but can be deduced by a person skilled in the art should be considered as part of the scope of protection of the present invention.

NUMERICAL REFERENCES

Drilling rig 2
Drill floor 21
Travelling block 23
Hoisting wire ropes 24
Drilling head 25
Pulley system 26
Mast 3
First structure 31
Fixing portion 312
Second structure 33
Moving system 5
First actuator device 51
First chamber 510
First rod 511
First end 512
First body 513
Second end 514
First channel 515
Second channel 516
First compartment 517
First orifice 518
Second orifice 519
Second actuator device 53
Second chamber 530
Second rod 531
First end 532
Second body 533
Second end 534
Third channel 535
Second compartment 537
Third orifice 538
Supply chamber 55
First passage 551
Pressurization chamber 57
First duct 572
Second duct 573
Pressurization circuit 59
Guide elements 7
Longitudinal extension L
First fluid flow f1
Second fluid flow f2
Third fluid flow P
Vertical direction Z

The invention claimed is:

1. A mast for telescopic drilling comprising:

at least one first structure fixed to a drill floor;

at least one second structure, the at least one second structure being movable relative to the first structure to obtain a telescopic mast;

a moving system, capable of extending and retracting a longitudinal extension of said telescopic mast by moving said at least one second structure; said at least one second structure at an upper end comprising a hoisting line handling system comprising a plurality of pulleys enabling hoisting lines to slide and move a travelling block and a drilling head connected to the travelling block along guides on sad mast;

said moving system comprising:

at least one first actuator device, which, at a first end at the at least one first actuator device, is fixed to said first structure or to said drill floor;

at least one second actuator device, which, at a first end of the at least one second actuator device, is fixed to said second structure;

at least one supply chamber, for supplying at least said at least one first actuator device and at least said at least one second actuator device;

wherein said at least one first actuator device and said at least one second actuator device are:

aligned along a single axis, and act in opposite directions.

2. The mast according to claim 1, wherein said at least one supply chamber is fixed to a second end of said at least one first actuator device and to a second end of the at least one second actuator device, the at least one supply chamber being arranged between the at least one first actuator device and the at least one second actuator device and moving with the at least one first actuator device and the at least one second actuator device in an integral manner.

3. The mast according to claim 1, further comprising:

one single first portion;

one single second portion;

one single first actuator device;

one single second actuator device; and one single supply chamber.

4. The mast according to claim 1, wherein said at least one first actuator device or said at least one second actuator device are pistons or oil-pressure cylinders and said at least one supply chamber is an oil-pressure chamber.

5. The mast according to claim 4, wherein each one of said actuator devices comprises a rod and a relative body; said rods slide inside the respective bodies along a vertical direction.

6. The mast according to claim 5, wherein at least one supply chamber and the first actuator device and the second actuator device connected thereto are shaped so that a stroke performed by said first actuator device and said second actuator device, after said first actuator device and said second actuator device have been activated, is substantially the same for all the actuator devices and said at least one first actuator device and said at least one second actuator device have a same bore diameter and a same length.

7. The mast according to claim 1, wherein the moving system comprises at least one pressurization chamber to supply the moving system.

8. The mast according to claim 7, wherein:

said at least one pressurization chamber is arranged in correspondence to the first end of the at least one first actuator device, and wherein said at least one pressurization chamber comprises:

a first duct, capable of being supplied for the extension of the mast and through which a first fluid flow flows;

a second duct, capable of being supplied, by a third fluid flow, for retraction of the mast, so as to allow a second fluid flow to flow through said first duct with a direction opposite to said first fluid flow.

9. The mast according to claim 1, further comprising:

at least one first duct fluidly connected:

to a first channel comprised in said at least one first actuator device, to said at least one supply chamber; and to a second chamber of the at least one second actuator device; and at least one second duct fluidly connected:

to a second channel comprised in the at least one first actuator device, to a first compartment of a first rod, to a pressurization circuit; and to a second compartment of a second rod of the at least one second actuator device.

10. A drilling rig comprising:

a drill floor;

a mast, which is arranged on said drill floor;

a drilling head, capable, in use, of sliding along said mast; wherein said mast is a telescopic mast according to claim 1.

11. The drilling rig according to claim 10, wherein a linkage mechanism is provided to move said drilling head, so as to move one or more drill pipes from a mouse hole to a well and vice versa.

* * * * *